US005690494A

United States Patent [19]

Luker

[11] Patent Number: 5,690,494

[45] Date of Patent: Nov. 25, 1997

[54] GOLF TEACHING AID

[76] Inventor: John E. Luker, P.O. Box 5203, Destin, Fla. 32540

[21] Appl. No.: 756,251

[22] Filed: Nov. 25, 1996

[51] Int. Cl.[6] ..... A63B 23/02; A63B 69/36

[52] U.S. Cl. ..... 434/252; 473/215; 473/277

[58] Field of Search ..... 434/252; 473/215, 473/216, 277, 276; 273/188 R, 189 R

[56] References Cited

U.S. PATENT DOCUMENTS

| | | | |
|---|---|---|---|
| 3,595,583 | 7/1971 | Oppenheimer | 434/252 |
| 4,582,325 | 4/1986 | Yuhara | 473/215 |
| 4,895,373 | 1/1990 | Richmon | 473/215 |
| 5,096,199 | 3/1992 | Wyatt, Jr. et al. | 473/215 |
| 5,154,416 | 10/1992 | Smull et al. | 473/215 |
| 5,209,482 | 5/1993 | Hopfer | 473/216 |
| 5,294,126 | 3/1994 | Armstrung, III | 473/276 |
| 5,295,690 | 3/1994 | Johnson | 434/252 |
| 5,390,929 | 2/1995 | Todaro | 473/277 |

*Primary Examiner*—Paul J. Hirsch

[57] ABSTRACT

A golf teaching aid for teaching a golfer proper swing positions and upper body golf muscles formed of an upper body yoke and a resilient cord attached between the yoke and a fixed object which creates resistance when a golfer rotates his body to simulate the rotational movements of a golf swing.

8 Claims, 4 Drawing Sheets

GOLF TEACHING AID

BACKGROUND AND SUMMARY OF THE INVENTION

The present invention relates to a golf teaching aid and in particular to a golf teaching aid which teaches proper position and strengthens the large muscles used in the execution of a golf swing.

It has long been recognized that the use of the large muscles is important to the execution of a proper golf swing. These muscles must be strong and they must assume the correct position during the swing. For example, the shoulders, hips and legs must turn in a circular path to create centrifugal force. The head must be kept still during the swing. The arms should be kept to the side of the body. The body should be in total balance in both the backward forward turns with no lateral weight shift. The spine should be in a straight line and hand and arm control of the club should be minimized. There have been a variety of golf swing training and exercising devices which have attempted to address the above needs.

For example, U.S. Pat. No. 3,926,430 to Good Jr. shows a golf exerciser device having an operating shaft with a pair of handles operated with the hands above shoulder level. The device provides a resistance against turning such as occurs during a golf swing, however, the arms and hands are away from the golfer's body. Furthermore, the device is rigid and provides only a preset resistance to the golfer.

U.S. patent to Douglas et al shows an energy absorbing and exercising machine, including a shoulder mounted frame attached to a fly-wheel arrangement for exercising during the turning movements of a golf swing.

U.S. Pat. No. 5,024,443 to Bellagamba uses elastic cords to provide resistance during the turning motion of a golf swing. U.S. Pat. Nos. 4,245,839 to Trent and 5,176,599 to Beliakov show other athletic training devices using elastic cords connected to a fixed member to create resistance against athletic motions.

U.S. patent to Arena shows a golf swing training device using elongated cords in a loop between the golfer and the ground.

U.S. Pat. No. 3,415,524 to Vickers shows a golf swing training apparatus using shoulder and arm attachments and provides resistance with a spring.

The present invention teaches a golfer to turn the shoulders, hips and legs in a circular path to create centrifugal force while keeping the head still and the arms close to the side thereby keeping the body in balance with proper weight shift and no lateral movement while at the same time the tendency for the hands and arms to take control. The invention teaches the golfer to maintain a straight spine thereby minimizing the occurrence of back injuries. The invention also strengthens the large muscles of the body used in the golf swing, including the back, hip and leg muscles. This is accomplished with an upper torso, adjustable yoke which fits snugly on the outside of the shoulders and upper arms of the golfer. The yoke includes a pair of downwardly projecting handles which are held by the golfer's hands during the exercise keeping the hands and arms fixed close to the body while the torso is turned. A resilient elastic cord is attached to the rear portion of the yoke and are attached to a rigid, fixed article such as a tree, door frame or golf cart to cite a few of any number of such articles. Preferably the yoke is provided with a groove or track on the outer peripheral surface to maintain the cord in place against the yoke when the golfer turns.

The yoke is formed in two pieces which are telescopically and adjustably attached using a pair of adjustment rails at the rear of the device. Each rail is provided with locator holes to accommodate a locking pin to fix the adjustment length. The inside of the yoke is provided with a foam pad which rests against the arms and shoulders of the golfer to provide comfort when the device is used as a training aid.

Among the objects of the present invention are the provision of a golf training aid which will strengthen the large leg, hip and back muscles of a golfer.

Another object of the present invention is the provision of a golf training aid which will teach the golfer the proper relationship and interaction of the various body parts during the execution of the golf swing.

Another object of the present invention is the provision of a golf training aid which can be used indoors and outdoors to practice a golf swing.

Still another object of the present invention is the provision of a golf training aid which is simple in structure and inexpensive to make.

These and other objects will become apparent with reference to the following written specification and the accompanying drawings.

DESCRIPTION OF THE PREFERRED EMBODIMENT

Figure 1:
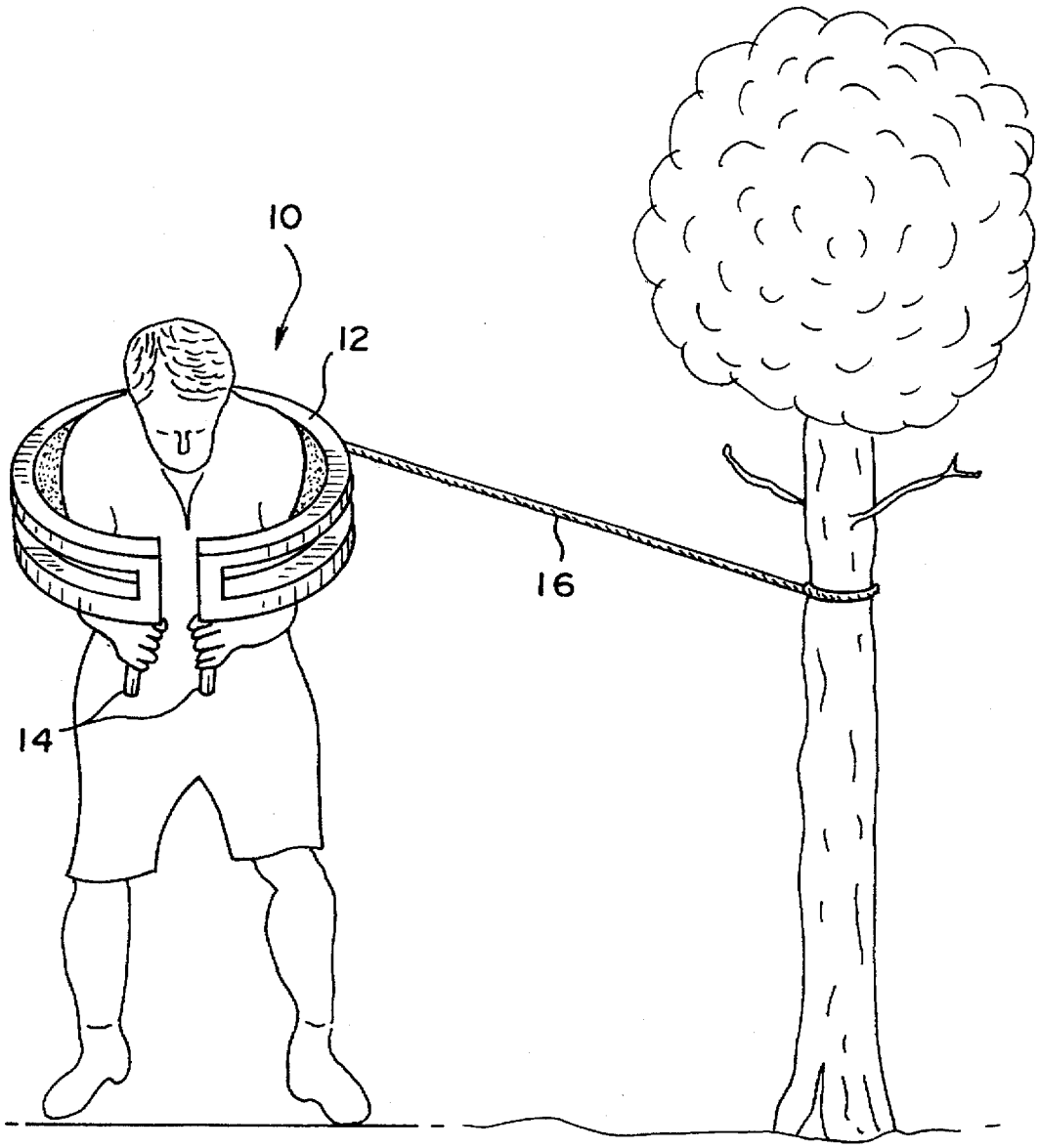
FIG. 1 is a pictorial view of a golfer using the Golf Training Aid of the present invention.
Figure 2:
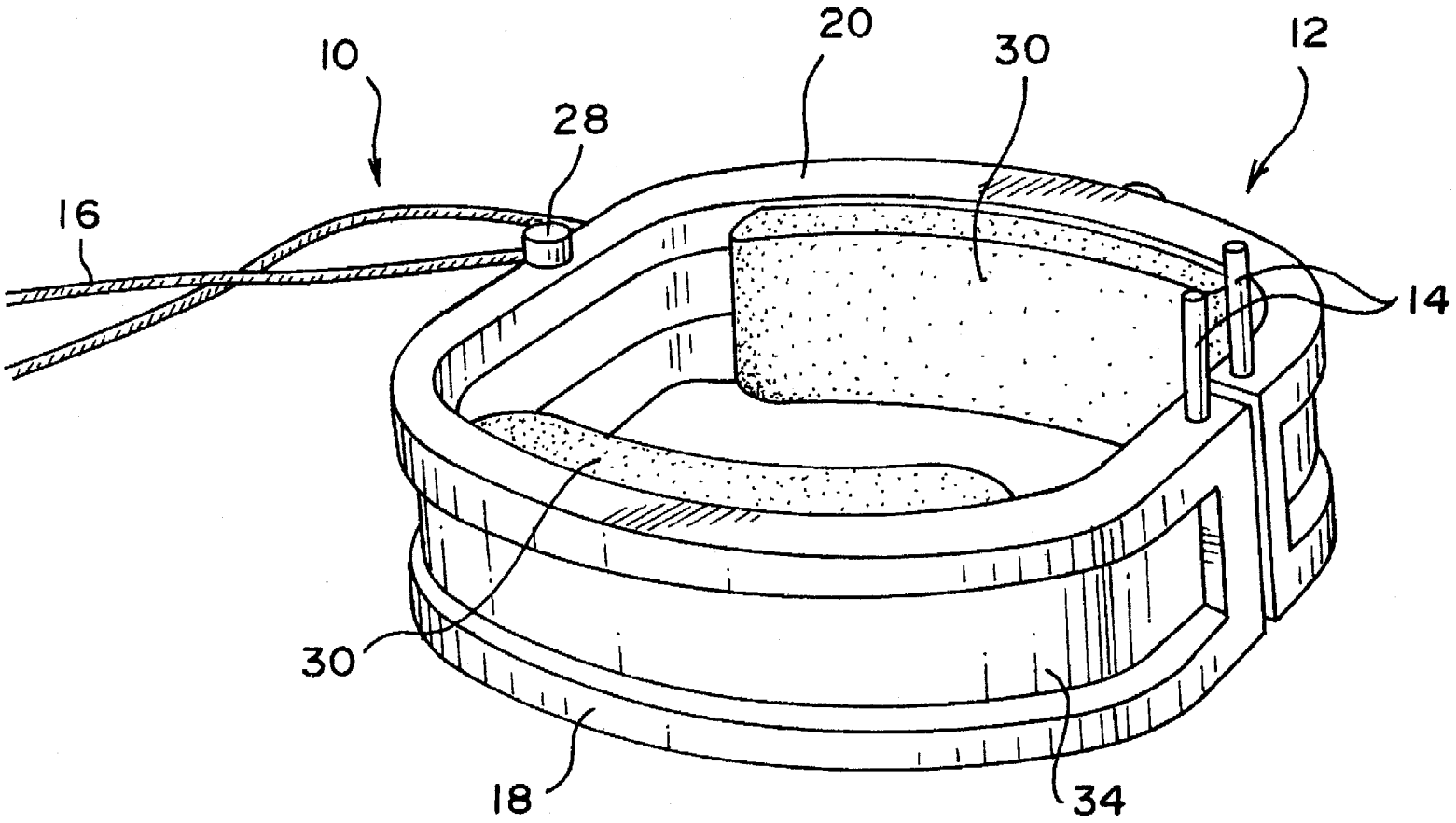
FIG. 2 is a perspective view of the invention.
Figure 3:
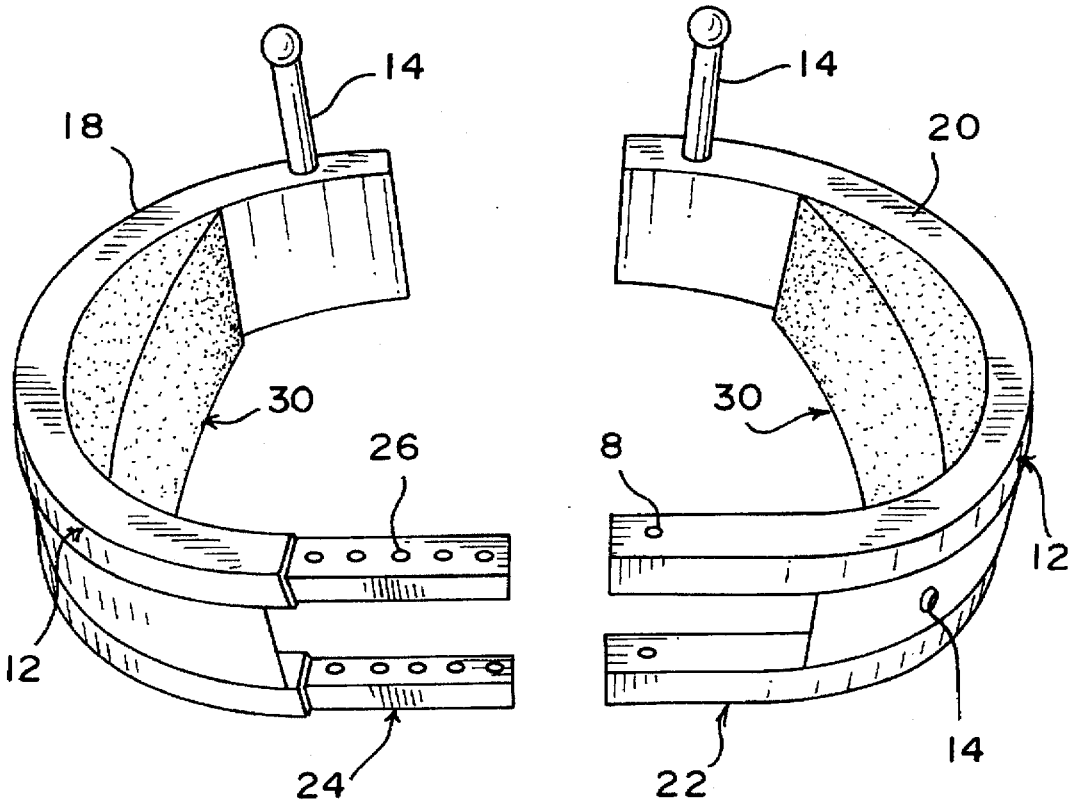
FIG. 3 is an exploded perspective view of the invention.
Figure 4:
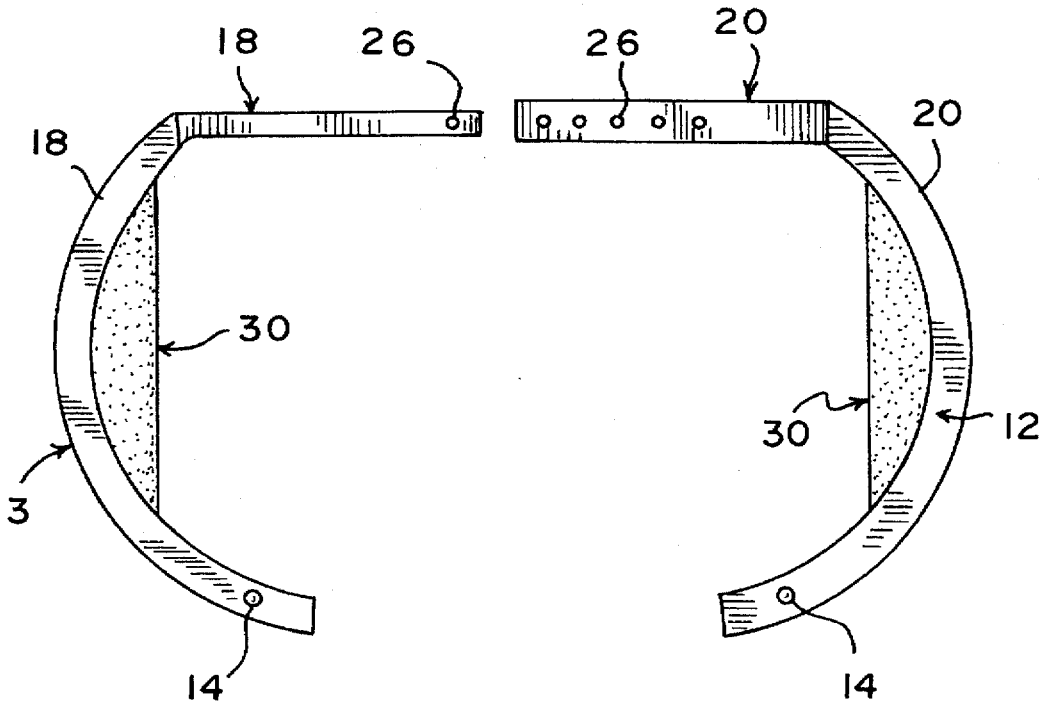
FIG. 4 is a top plan view of the invention.
Figure 5:
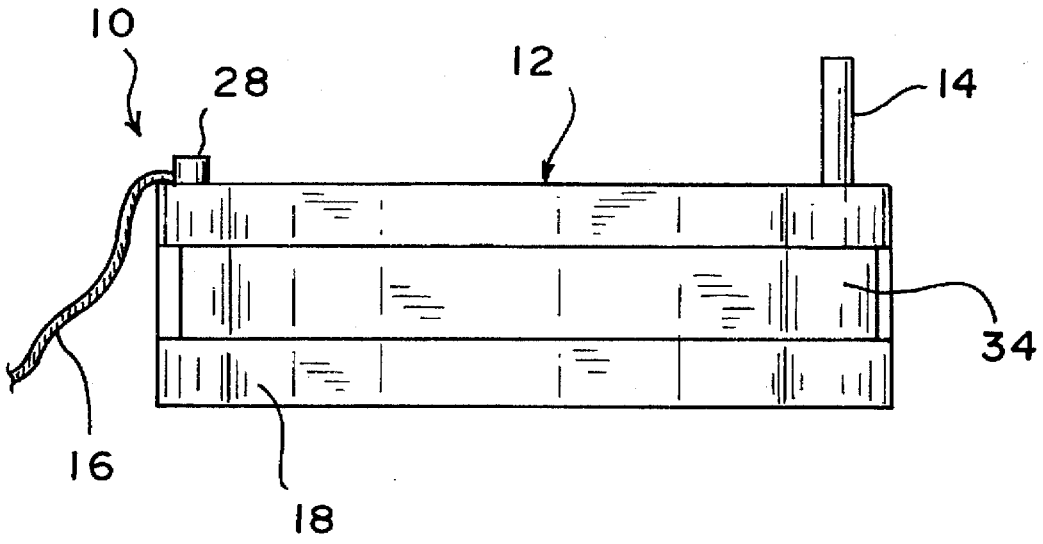
FIG. 5 is a side elevational view of the invention.
Figure 6:
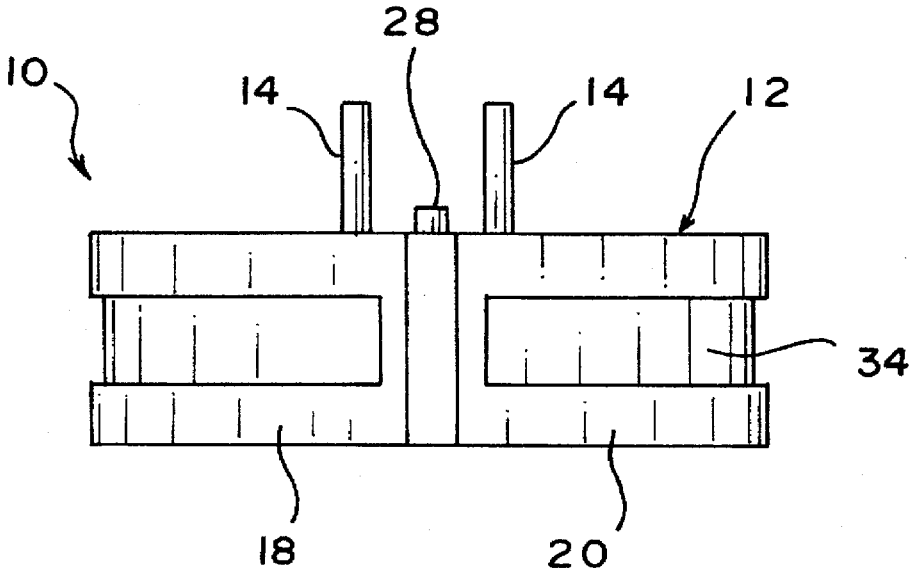
FIG. 6 is a front elevational view of the invention.

Referring to the drawings, FIG. 1 shows the golf training aid 10 of the present invention in position on the shoulders and upper arms of a golfer. A adjustable yoke 12 includes a pair of downwardly projecting handles 14 and a resilient cord 16 having one end fixed to the yoke and a free end attached to a tree.

FIGS. 2–6 show details of the golfing aid 10 of the invention. The yoke 12 is formed of two sections 18 and 20 which are generally arcuate in shape forming an oval shaped structure which accommodates the upper torso of a golfer. The sections 18 and 20 are connected by a pair of telescoping adjustment rails 22 and 24. Each adjustment rail includes a series of holes 26 which cooperate with an anchor pin 28 to fix the sections together and prevent movement therebetween once the structure is sized for a particular golfer. The inner surface of each of the sections 18 and 20 includes a foam pad 30 to provide a comfortable and snug fit against the shoulders and upper arms of the golfer when the golfing aid 10 is used. A pair of handles 32 extends downwardly from the front ends of the sections. The outer surfaces of the section 18 and 20 are formed with a groove or track 34 suitable to accommodate the resilient cord 16. One end of the cord 16 is preferably formed with a loop which is engaged by the anchor pin 28.

In use, the sections 18 and 20 are adjusted to an individual golfer with the telescoping adjustment rails 22 and 24. Once a precise fit is obtained the anchor pin 28 is inserted into a pair of adjustment holes 26 to fix the sections in the selected position. The golfing aid 10 is placed on the upper body of the golfer so it snugly fits against the shoulders and upper arms. One end of the resilient cord 16 is attached to the anchor pin and the other end is fixedly attached to a rigid structure such as a tree, golf cart or door frame as examples. The golfer positions himself so that the resilient cord 16 is fully extended which can be determined when a slight pressure is felt. The golfer then grasps the handles 14 to position his arms against his body and rotates his upper body backwardly and forwardly simulating the rotational movement of a golf swing. As the upper body is rotated, the resilient cord 16 wraps around the outer surfaces in the track 34 of the golfing aid 10 and increases in tension stressing the muscles of the golfer thereby exercising them and increasing their strength. By keeping the cord 16 in the track 34, the golfer is assured of maintaining a proper position. As muscles become stronger, the golfer may add additional resilient cords to increase resistance.

While a preferred embodiment has been shown and described, it will be appreciated that there is no intent to limit the invention by such disclosure, but rather, it is intended to cover any changes, variations, modifications and/or alternate constructions falling within the spirit and scope of the invention as defined in the appended claims.

I claim:

1. A golf teaching aid comprising:

an upper body yoke structured to snugly fit the shoulders and upper arms of a user; at least one handle attached to a forward portion of said upper body yoke and extending downwardly therefrom; and a resilient cord having a first end attachable to a rearward portion of said upper body yoke and a second end attachable to a fixed object; whereby rotational movement of said upper body yoke against resistance of said resilient cord teaches the user proper golf swing positions and strengthens golf muscles of the user.

2. The aid of claim 1 wherein said yoke is formed in two adjustable sections;

said sections being moveable relative to the other to expand and decrease the relative width between the sections.

3. The aid of claim 2 wherein said yoke includes adjustable rails telescopically connected and means to secure said rails fixed relative to each other.

4. The aid of claim 3 wherein said means to secure said rails is an anchor pin and a series of holes in said rails cooperating therewith.

5. The aid of claim 1 further including a track formed on an outer surface of said yoke; said track maintaining said cord on said outer surface during rotational movement.

6. The aid of claim 1 further including a pad on an inner surface of said yoke for abutting the shoulders and upper arms of the user.

7. The aid of claim 1 wherein said yoke is generally oval shaped conforming to the shape of the upper torso of said user and formed of two relatively adjustable sections.

8. The aid of claim 2 being further defined by two handles; one of said two handles being located on each adjustable section.

* * * * *